United States Patent [19]

Hanyo et al.

[11] 4,122,697

[45] Oct. 31, 1978

[54] MEANS AND METHOD FOR REDUCING RADIUS EXPANSION IN THE BENDING OF ELONGATED MATERIALS

[75] Inventors: Susumu Hanyo, Yokohama; Jousuke Yamaguchi, Kanagawa; Yoshiyuki Morishita, Tokyo; Itoshi Noguchi, Kawasaki, all of Japan

[73] Assignee: Daiichi Koshuha Kogya Kabushiki Kaisha, Japan

[21] Appl. No.: 709,929

[22] Filed: Jul. 29, 1976

Related U.S. Application Data

[62] Division of Ser. No. 593,961, Jul. 8, 1975, Pat. No. 4,062,216.

[30] Foreign Application Priority Data

May 30, 1975 [JP] Japan ..... 50-64956

[51] Int. Cl.[2] ..... B21D 7/16; B21D 7/024

[52] U.S. Cl. ..... 72/128; 72/342; 72/364; 72/702; 72/369

[58] Field of Search ..... 72/128, 149, 152, 145, 72/155, 342, 364, 369, 702, DIG. 22, 310, 318

[56] References Cited

U.S. PATENT DOCUMENTS

| | | | |
|---|---|---|---|
| 2,812,004 | 11/1957 | Huet | 72/128 |
| 3,156,287 | 11/1964 | Munro | 72/DIG. 22 |
| 3,352,136 | 11/1967 | Clarke | 72/702 |
| 3,368,377 | 2/1968 | Hirayama et al. | 72/128 |
| 3,896,649 | 7/1975 | Stuart | 72/128 |
| 3,902,344 | 9/1975 | Stuart | 72/128 |

FOREIGN PATENT DOCUMENTS

| | | | |
|---|---|---|---|
| 541,032 | 9/1921 | France | 72/702 |

*Primary Examiner*—E. M. Combs

*Attorney, Agent, or Firm*—Burns, Doane, Swecker & Mathis

[57] ABSTRACT

A means and method is provided for reducing radius expansion of bent, elongated materials due to "spring-back" occurring after the material is released from the bender clamps of a hot bending apparatus, wherein the longitudinal axis of the unbent portion of the material is displaced by a small angle from a perpendicular to a line running through the center of the bend and the bender heating means.

8 Claims, 10 Drawing Figures

MEANS AND METHOD FOR REDUCING RADIUS EXPANSION IN THE BENDING OF ELONGATED MATERIALS

RELATED APPLICATION

This is a divisional application of pending prior application No. 593,961 filed on July 8, 1975, U.S. Pat. No. 4,062,216.

BACKGROUND OF THE INVENTION

There are known two general methods for accomplishing bending work on metal pipes, rods, or the like. In cold bending the desired bending work is performed by giving to the work piece a bending moment that exceeds the elastic limit of the work piece at normal temperature. In hot bending the bending work is accomplished by giving a bending moment to the work piece by heating it to a temperature that induces plastic deformation of the work piece. Cold bending is suited for relatively small diameter metal pipes or the like of which no high product precision is required, but it is not suited for relatively large diameter metal pipes or the like of which high product precision is required. On the other hand, hot bending is suited for relatively large diameter metal pipes or the like of which high product precision is required, but fairly large-scale equipment and heating apparatus is required. Also, as work efficiency is poor, the working cost is high.

Attempts have been made to overcome these problems, and there have been recently developed and put to practical use an improved method and apparatus for effecting bending work by hot bending, according to which a metal pipe or the like to be worked is first passed through a heating device such as for example a high frequency inductor which is capable of effecting high temperature heating over a limited area, with the end or a suitable middle part of said pipe being clamped to an arm which is freely swingable and whose axis of the revolution is located within the plane of said heating device, the arm also having a length that matched the bending radius of said pipe. Then, with the pipe being continuously driven straight forward, it is subjected to local heating to a plastic deformation inducing temperature by said heating device, which is immediately followed by cooling so as to effect continuous plastic deformation in said heated area of said pipe while giving a bending moment to said pipe, thereby to accomplish the desired bending.

Referring first to FIG. 1, there is shown such a conventional bending apparatus. In the figure, reference numeral 1 designates a steel pipe to be bent, a support block 2 is adapted to support the pipe end and is formed integral with the means for continuously and straightforwardly propelling the steel pipe 1, also provided are a pair of guide rolls 3 and 4, a heating device 5 such as an annular high frequency inductor which is capable of heating a limited area of the steel pipe 1 sidewise to a high temperature, and a cooling device 6 integral with said heating device. A rocker arm 7 is mounted on the pivotal shaft 8 arranged such that its center resides within the plane of the heating device 5, and a clamp 9 fixed to the arm 7.

In operation of the apparatus just described, steel pipe 1 is first passed between guide rolls 3 and 4 and then further passed through heating device 5 as shown in the drawing. The pipe end is supported by support block 2 of the propelling means, and in certain applications, in end or a suitable middle portion of the steel pipe 1 is fastened to the arm 7 by the clamp 9. The steel pipe 1 is continuously fed straightforwardly by the propelling means while subjected to local heating by heating device 5 to a plastic deformation inducing temperature, and this treatment is immediately followed by cooling so as to effect continuous plastic deformation of the steel pipe 1 in its heated area while giving a bending moment to the pipe by the thrust of the propelling means under the guidance of the arm 7, thereby to accomplish the desired bending. Thus, according to this apparatus, the desired bending of steel pipe can be performed at high efficiency without requiring any elaborate thermal works. The same effect can be obtained by using this apparatus for bending of other types of metal pipes or metal strips. It is to be particularly noted that no bending mold is required and it is possible to bend the pipe at any desired radius of curvature.

According to this method and apparatus, the desired bending can be accomplished on elongated materials very efficiently with some precision, but when the clamp is released upon completion of the bending, there may occur so-called spring back to cause expansion of the bending radius (hereinafter referred to "R expansion"). Known bending means and methods do not avoid "R expansion".

Therefore, it has been attempted heretofore to carry out the bending with a bending radius that makes allowance for possible spring back. This measure, however, is still unsatisfactory.

In a known method performed as shown in FIG. 2, a pipe 1 to be worked is passed between guide rolls 3, 3' and 4, 4' and then through heating device 5 and fastened to clamp 9 at the end of arm 7. Thus, the pipe 1, while moved forwards by thrust P, is heated locally by heating device 5 to a plastic deformation inducing temperatures and then immediately cooled by a cooling device (not shown), so as to induce continuous plastic deformation in said heated area of said pipe while giving bending moment thereto. The axis of the unbent pipe portion is rectilinear. The position of the vertical line extending down to the center $\theta$ of bend as well as the distance of shift of the heating point A from the axial line XX' is slightly changed by change of the bending angle $\theta$, so that when clamp 9 is loosened to release the pipe upon completion of the bending work, the fastened portion, or the clamp portion CD, may not only spring back to the position of CD, and consequently, the bending radius does not stay uniform with respect to the bending angle resulting in increased bending radius at the termination of bending.

In recent years, pipelines are popularly used for the transportation of fluids, and the number of steel pipes used for such pipelines is increasing at a high rate. Also, more and more high precision is required for bending such pipes.

Thus, demand has been voiced in the industries for development of a method and apparatus wich are capable of effecting bending metal pipes such as steel pipes with higher precision than is attainable with the presently available techniques.

In view of the above, the present invention has for its object to provide a method and apparatus which are capable of bending long metal materials such as pipe, bar and rod with high efficiency and high precision.

It is another object of the present invention to provide a method and apparatus which are capable of bending steel pipes used for constructing pipelines for fluid transport without causing any undesirable phenomenon such as R expansion.

These and other objects and features of the invention will become apparent from the claims and from the following description when read in conjunction with the appended drawings.

THE DRAWINGS

DETAILED DESCRIPTION

Figure 1:
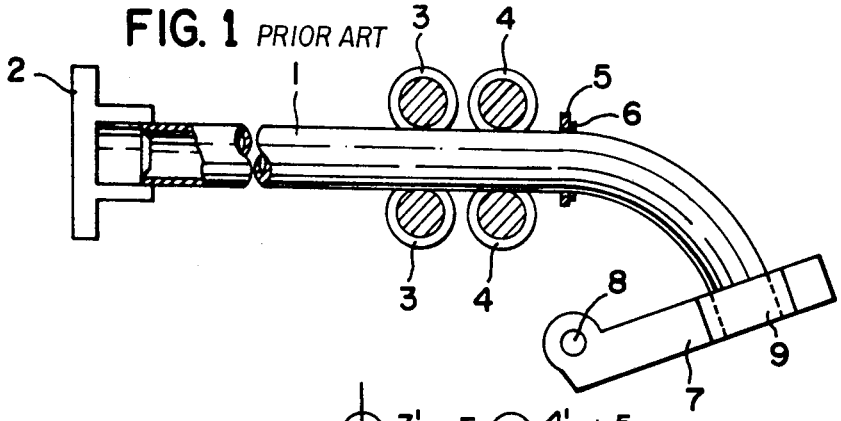
FIG. 1 PRIOR ART
FIG. 1 is a plan view of a conventional apparatus which serves as a basis for the present invention.
Figure 2:
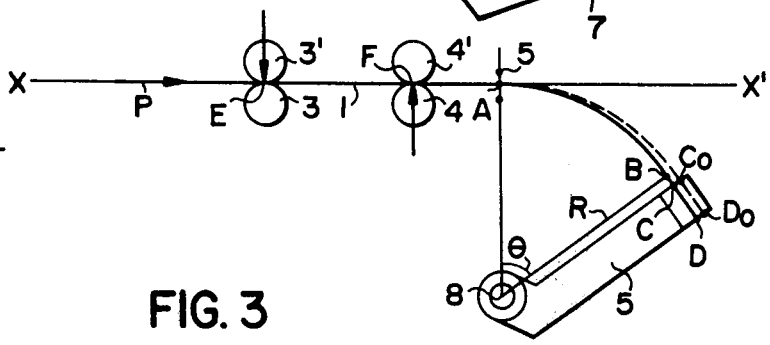
FIG. 2 PRIOR ART
FIG. 2 is a schematic illustration of a conventional bending method performed by the apparatus of FIG. 1.

The problems discussed in connection with the bending method of FIG. 2 can be overcome if the metal pipe to be worked is moved forwards while keeping it at a postion where it has turned a slight angle from the point of intersection of the line connecting the center of bend and heating device and the line crossing the first line at right angles, or if the heating device is disposed at the position where it has turned a slight angle from the center of bend on the straight line in the direction of advancement of the metal pipe and with respect to the vertical line connecting the straight line and center of bend, thereby to confine the apparent spring back to zero. Further, if need be, means are provided for detecting the change of curvature of the metal pipe during the bending, and if such change is detected, the heating device is moved to keep the bending radius constant throughout the bending work. These arrangements can preclude the phenomenon of "R flow".

Figure 3:
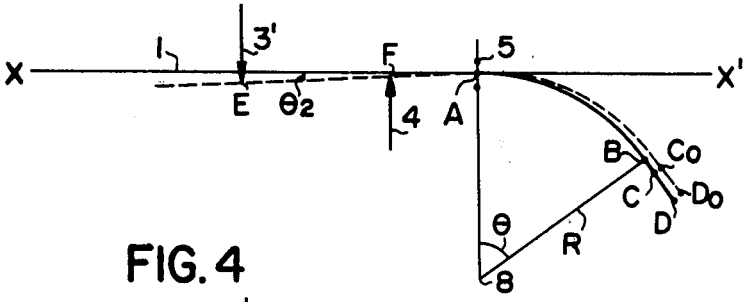
FIGS. 3 to 5 are schematic illustrations of the method performed according to the present invention.
Figure 4:
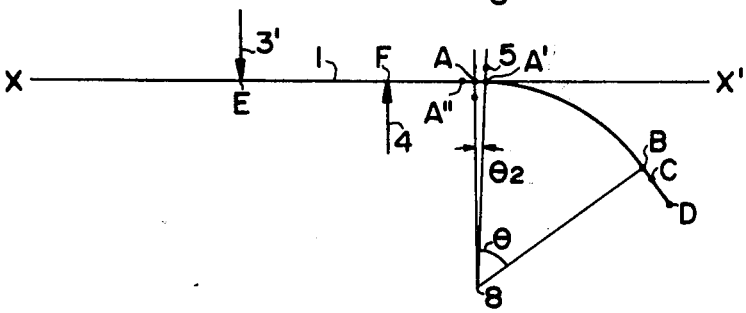

FIGS. 3 to 10 are drawings which illustrate these arrangements. With reference to these drawings, FIGS. 3 and 4 illustrate means for reducing or eliminating te spring back which has been present in the bending of the metal pipe according to a conventional method. According to the method of FIG. 3, the base portion of the pipe 1 is given a slight turn $\theta_2$ from the heating point A with respect to the axial line XX' so as to provide extra plastic deformation at the heating point A. If spring back after release of the clamps should take place as shown by dotted line the bending radius will be correct. It will be apparent that if the dotted line is rotated through an angle of $\theta_2$ about the heating point A to let the base pipe portion coincide with the axial line XX', then the clamp portion CD wll coincide with CD on the axial line of the clamp. According to this method, the bending radius after the bending work becomes equal to the radius R which is the radius when the pipe was set to the apparatus, and in consequence, apparent spring back is reduced to zero.

According to the method of FIG. 4, heating means 5 is turned a slight angle $\theta_2$ about te center of bend 8 and the heating point A'. While kept in agreement with axial line XX', it is moved to point A', and the bending is performed with the base portion of the pipe 1 being in agreement with the axial line XX', thereby to expunge spring back after the work. To be more precise, OA' becomes slightly greater than OA, but as the angle $\theta_2$ is extremely small, the difference between OA' and OA may be ignored. For instance, in case of bending a pipe with outer diameter of 60.5 mm and thickness of 3.2 mm at the bending radius of 300 mm, if $\theta_2$ is set at 0.76°, spring back is reduced to zero, but the rate of change of the bending radius is given as follows:

$$\frac{(OA' - OA)}{OA} = \frac{1}{\cos\theta_2} - 1 \div 9 \times 10^{-5} \quad (1)$$

That is, the rate of change is merely 0.03 mm when the radius is 300 mm. Also, the bending radius of the finished article can be made smaller than the original radius (that is, the radius of the pipe when set in the apparatus) by further shifting the heating point A from A' to the former postion.

Thus, according to the methods shown in FIGS. 3 and 4, the apparent spring back in the finished article can be reduced to zero. Further, even if the load at each fulcrum varies with change of the bending angle, the bending radius in the finished article can be qualized to the original radius of the pipe as set in the apparatus (that is, the length of the line drawn from the center of bend 0 to the center line of clamp 9) by suitably controlling the value of the angle $\theta_2$ regardless of the bending angle $\theta$. For achieving this, there is required a curvature change detecting means for giving a signal to the control system.

Figure 5:
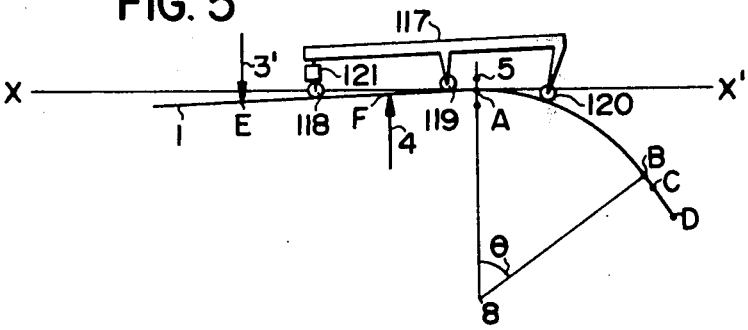

With reference to FIG. 5, the numeral 117 designates generally the curvature change detecting means comprising contactors 118, 119 contacted with the base portion of the pipe 1, a contactor 120 contacted with the bent portion of the pipe, and a displacement detector 121 provided at the supporting portion of the contactor 118. Arrangement is made such that the contactor 118 contacts the base pipe portion at a position intermediate guide rolls 3' and 4 while the contactor 119 contacts said base portion at a position as close to heating means 5 as possible. On the other hand, contactor 120 is arranged to contact the bent portion of the pipe 1 at a location sufficiently distant from the heating point A so that change of curvature in the heating point A will present itself sufficiently as a displacement of the bent portion of pipe 1. The configuration of contact areas and contact pressure are suitably selected such that the contactors 118, 119, 120 will contact the outer wall of the pipe 1 strongly along as small an area as possible.

Figure 6:
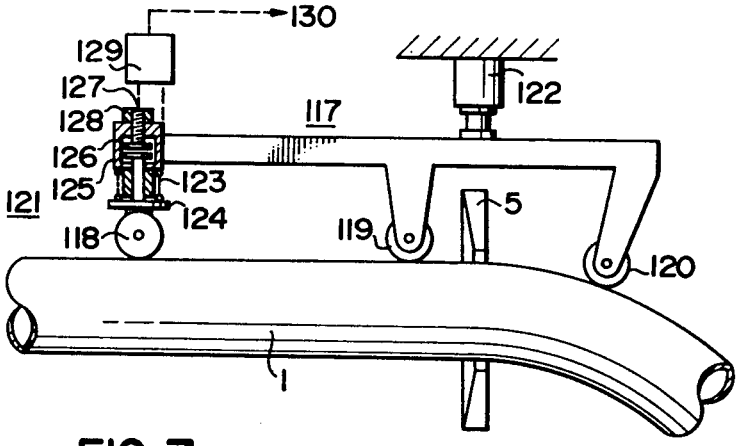
FIG. 6 is a plan view of a curvature change detector of an embodiment of the present invention.

With particular reference to FIG. 6, the displacement detector 121 includes a hydraulic cylinder 122 for pressing the contactors 119, 120 against the pipe 1 at a constant strong pressure. A spring 123 for pressing the contactor 118 against the pipe 1 with a strong force, a spring stop 124 for securing an end of the spring 123, a flat plate 125 integral with the contactor 118 and another flat plate 126 fixed in the detector 121 in parallel to the plate 125 are provided. A screw 127 and a nut 128 for suitably adjusting and fixing the position of the flat plate 126. An electrical detection means including an oscillator 129 measures the change of the distance between the plates produced by the change of curvature during the bending of pipe 1 and converts the measurement into a control signal 130.

Thus, when a change of curvature occurs during the bending and such change is detected by detector 121, an appropriate displacement is given to guide rolls 3', 4 in FIG. 3 to cause a change of the contact pressure at the acting points E and F of these rolls 3' and 4 to the pipe to change the angle $\theta_2$. That is, if the curvature is reduced and the radius enlarged, contact pressure of contactor 120 to the pipe 1 at that position is increased, and as a result, the curvature change detecting means 117 is turned slightly about contactor 119 by the action of the cylinder 122 and the distance $\alpha$ between the flat plate 125 secured to contactor 118 and the flat plate 126 secured to displacement detector 121 is reduced to change the signal 130 and $\theta$ is accordingly reduced. On the other hand, if the curvature is enlarged and the radius reduced, a displacement just contrary to the above-said one occurs to give a contrary signal to enlarge the angle $\eta_2$. There are available various types of methods for changing $\theta_2$, and some examples of such methods are hereinafter discussed.

Figure 7:
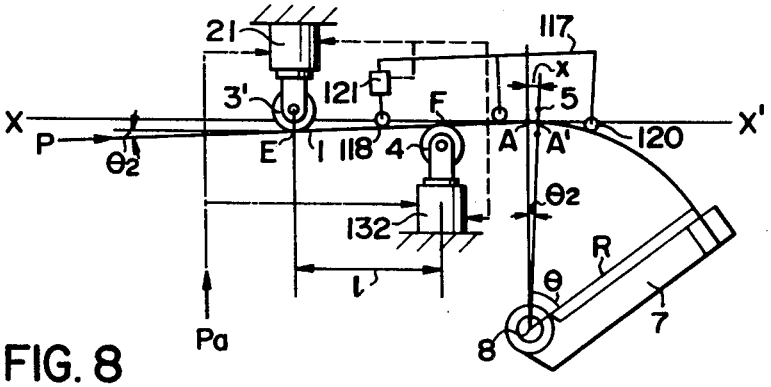
FIGS. 7 to 10 are additional schematic illustrations of embodiments of the present invention.

Guide rolls 3', 4 are displaced simultaneously in a first method. As shown in FIG. 7, numerals 131 and 132 designate hydraulic cylinders for supporting and, if need by, moving the guide rolls 3',4. These hydraulic cylinders 131, 132 are of a same output and associated with a displacement detector 121. Guide rolls 3', 4 are supported by the hydraulic cylinders so that the guide rolls 3', 4 will act to provide the same load in the different directions at the acting points E, F so as to give a moment acting outwardly as seen from the center of bend 8 at the heating point A' and to leave no shearing force, that is, to form a bend of a simple moment.

Thus, hydraulic cylinders 131, 132 fix these means to the body portion of the apparatus and, if given a constant hydraulic pressure P, they operate to produce a uniform bending moment M during the time when they move from the guide rolls to the heating point A', the moment M being given by the equation.

$$M = wl \tag{2}$$

where $w$ is the output of each hydraulic cylinder; and, l is the distance between the acting points E and F of guide rolls 3' and 4.

Therefore, the amount of $\theta_2$ can be varied by changing the hydraulic pressure in correspondence to the signal 130 from the detector 121.

Conventional bending devices are intrinsically capable of bending pipes with extremely high precision until the bending angle $\theta$ reaches about 45°. Therefore, within such range of bending angle, the bending can be carried out in the conventional way with no need of making any extra control works and keeping guide rolls 3, 3', 4, 4' fixed. When bending is started while keeping the guide rolls in agreement with the axial line XX', it is necessary to set the heating means 5 at a position where it has advanced the distance:

$$x_1 = R\epsilon \tag{3}$$

corresponding to the slight angle $\epsilon$ of turn of the arm 7 by the time the bend begins to appear. Also, for reducing spring back to zero, the position of heating means 5 must be further advanced the distance:

$$x_2 = R\theta_2 \tag{4}$$

which is equivalent to the slight angle $\theta_2$ of turn in FIG. 4. In detecting the bending angle, the slight turn of arm in not counted in the initial stage.

Figure 8:
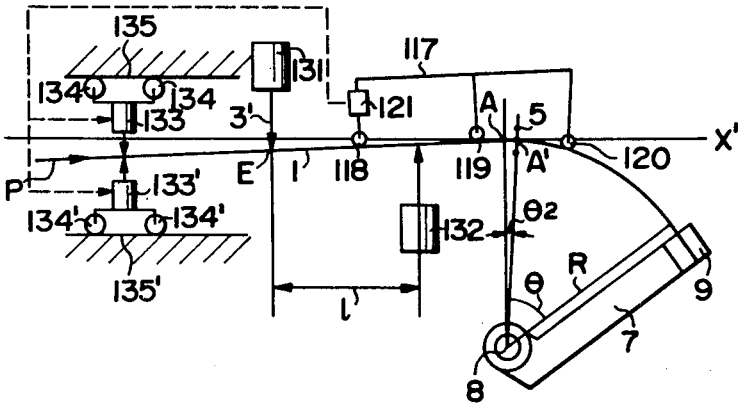

The guide rolls 3', 4 are arranged freely displaceable in a second method in which a constant load is applied and the angle of slant $\theta_2$ of the base portion of pipe is changed by displacement of the distal end of the portion. As shown in FIG. 8, 133 and 133' designate hydraulic cylinders in contact with the base portion of the pipe 1. They are mounted with rollers 134, 134' movable on guide rails 135, 135' provided on the body portion of the apparatus and are associated with displacement detector 121. Guide rolls 3', 4 are applied with a constant load $$W = \frac{Ma}{1} \tag{5}$$

where M$a$ is the bending moment sufficient to induce plastic deformation at a specified temperature in the pipe 1 at the heating point A'.

This can be accomplished the same way as in the first method, but the hydraulic pressure applied to hydraulic cylinders 131, 132 is kept contant. For controlling the angle of slant $\theta_2$, thrust P is applied to point G at the distal end of the pipe 1 while giving a suitable displacement by hydraulic cylinders 133, 133'. The angle of slant $\theta_2$ of the base portion is controlled by the signal from displacement detector 121.

This method is superior in stability to the above-described first method. This is because the first method involves the possibility that the resistance of the distal end of the pipe 1 which gives thrust could impair smoothness of control. Also, this second method ensures positive operation as hydraulic cylinders 133, 133' directly overcome the resistance of the distal end of the pipe to allow very effective control.

It is to be also noted that as the point G advances in coincidence with bending, hydraulic cylinders 133, 133' are arranged movable parallel to the axial line XX' by means of rollers 134, 134' and guide rails 135, 135'.

Figure 9:
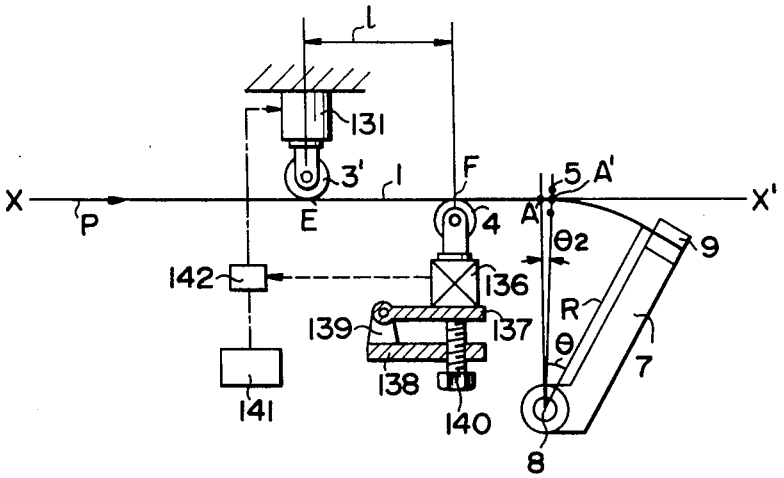

The guide roll 4 is fixed while the guide roll 3' is displaced by hydraulic cylinder 132 alone to change angle of inclination $\theta_2$ of the base portion of pipe in a third method. As shown in FIG. 9, numeral 136 designates a load gauge provided in attachment to the support portion of guide roll 4, and a swingable block 137 is pivotally secured to a support 139 provided on a pedestal 138. The swingable block 137 carries the load gauge 136 and is arranged to let the guide roll 4 lightly contact the pipe 1 by adjusting a screw 140. There are also provided a hydraulic pressure generator 141 and a hydraulic pressure adjuster 142, the latter being associated with said hydraulic cylinder 131 and load gauge 136 so that the load gauge 136 is operated by said hydraulic cylinder 131.

Thus, according to this method, guide roll 4 is not displaced but kept at the fixed position, and the oil pressure of the hydraulic cylinder 131 is adjusted to prevent R flow. It is possible with this method ot prevent R flow but a slight error is produced in the bending radius R. Such error, however, is quite small, less than 0.8 mm when bending work is performed with bending radius of 200 mm, so that no trouble arises in practical applications. When for instance a bend of 180° is made, there takes place about 1 percent of R flow whereas the error is not more than about 0.3 percent.

Most important in this method is selection of the acting point of guide roll 4 and the method of hydraulic pressure adjustment of hydraulic cylinder 131. A preferred way of achieving this is described below.

Before starting the work, heating means 5 is set at a position where it has advanced a distance corresponding to the angle $\theta_2$ as shown in FIG. 26, and the heating point is selected at A'. Then the pipe 1 is set in position and screw 140 is adjusted so that guide roll 4 lightly contacts the pipe 1. In the meantime, hydraulic cylinder 131 is operated to let guide roll 3' lightly contact the pipe 1, and then the position of hydraulic cylinder 131 is fixed.

Under these conditions, heating of the point A' is started and thrust P is applied to start bending of the pipe. This bending is continued until the bending angle reaches about 30°. Here, hydraulic cylinder 131 is operatively associated with load gauge 136 and inclination of the base portion of the pipe is automatically adjusted by displacement of guide roll 3'. As the bending is carried on in this way, contact pressure Fp of guide roll against the pipe 1 is reduced and the difference between the pressure Fp and the contact pressure Ep of guide roll 3' against pipe 1 is increased, with said conatact pressure Ep having the tendency to decrease. Then, automatic control is made such that the detected pressure of load gauge 136 becomes equal to the operating pressure of hydraulic cylinder 131 and that Ep becomes equal to Fp.

For achieving this, hydraulic pressure from hydraulic pressure generator 141 is adjusted in cooperation with hydraulic pressure adjuster 142 and load gauge 136 so that hydraulic cylinder 131 will produce a load equal to the detected load, whereby the contact pressures of guide rolls 3' and 4 against pipe 1 can be kept equal to each other in absolute value in the opposite directions. Consequently, shearing force at the heating point A' dies away and also elastic deformation in the bent portion of the pipe is diminished to substantially eliminate R flow. Thus, the desired bending can be accomplished with satisfactorily high precision for practical uses even if the curvature change detecting means 117 is not used.

Figure 10:
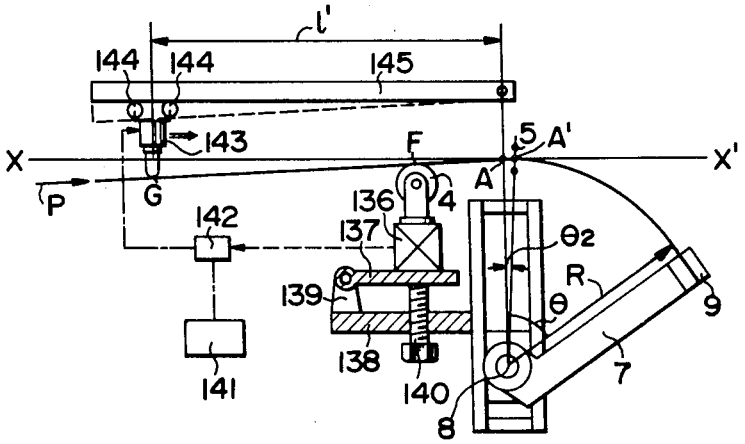

The guide roll 4 is fixed and loading pressure of guide roll 4 and operating pressure of hydraulic cylinder 133 are kept equal by hydraulic cylinder movable with thrust means at distal end of pipe 1 in a fourth method. As shown in FIG. 10, numeral 143 designates a hydraulic cylinder the same as the hydraulic cylinder 133 in FIG. 8. It is provided with rollers 144 rollable on guide rails 145 provided on the body portion of the apparatus in parallel to the axis XX'. This method is otherwise the same as the third method. Hydraulic cylinder 143 is connected to hydraulic pressure adjuster 142, and during the bending, load is applied to the distal end of pipe 1 and adjusted to become equal to the load of guide roll 4. A noticeable difference from the third method is that the distance 1' between the acting point G of hydraulic cylinder 143 and guide roll 4 is far longer than the distance 1 between guide rolls 3' and 4 during the early phase of bending of the pipe 1, so that the load Fp of guide roll 4 is reduced to consequently improve the bending precision.

In the third and fourth methods, curvature change detecting means 117 is not used, but such means may be used in interlocked relation with hydraulic cylinders 133 and 143.

Therefore, it is possible to prevent both R expansion and R flow simultaneously by giving a necessary amount $\theta_2$ for preventing R expansion while shifting the heating means 5 from the bending position where R flow occurs to the point A and A' gradually during the bending work. In addition, where hollow elongated material is bent, flexing or flattening of the material may be prevented by providing, in combination with the above described apparatuses, means for applying pressure to the material from the direction perpendicular to the crushing force exerted in the bending process.

When heating means 5 is moved in the direction of A and A' in FIG. 4, that is, in the direction opposite to the direction of advancement of pipe 1, the bending radius R may enlarge, so that the bending radius to be set in the apparatus is beforehand reduced to make allowance for such possible enlargement of the bending radius, and the heating point is set at A'' to start the bending from this position. That is, the bending work is practiced while gradually returning the pipe 1 toward the point A from the bending position where R flow is produced.

The principles, preferred embodiments and modes of operation of the present invention have been described in the foregoing specification. The invention, which is intended to be protected is not, however, to be construed as limited to the particular forms disclosed, since these are to be regarded as illustrative rather than restrictive. Variations and changes may be made by those skilled in the art without departing from the spirit and scope of the present invention.

We claim:

1. In an apparatus for hot bending elongated materials having an annular heating means for locally heating a limited portion of the material, an arm freely pivotable about an axis in the plane of the heating means, a clamp carried by said arm for engaging a leading portion of the material, and means for continuously advancing the material through said heating means and guiding the trailing, unbent portion of the material, the improvement wherein said advancing and guiding means is operative to maintain the longitudinal axis of the unbent portion of the elongated material at an acute angle with respect to a perpendicular to the plane of the heating means during the bending of the pipe by the pivotable arm, said angle being selected to compensate for the spring back material when the material is unclamped so that the material has the desired bending radius when the material is unclamped.

2. The apparatus of claim 1 further comprising means for detecting change in the radius of curvature of the material and moving the heating means a suitable distance to compensate therefor.

3. The apparatus of claim 2 further comprising means for detecting change in the radius of curvature of the material and for turning the unbent portion of the material a suitable angle to maintain the bending radius constant.

4. An apparatus for hot bending, elongated metal materials such as metal pipes of circular cross section comprising:

heating means for heating a limited area of the metal material to a high temperature;

cooling means for cooling the heated area immediately after the heating thereof;

an arm which is freely pivotable about an axis located within the plane of said heating means, said arm being also adapted to clamp a portion of the metal material to guide the portion in its bending direction;

means for applying pressure to the material from the direction generally parallel to the axis of pivoting of said arm, at a suitable location behind said cooling means;

means for continuously advancing a metal material to be bent; and, means for guiding the metal material so that the unbent portion of the material is advanced toward the heating means while maintained in a position where it has turned a suitable angle from the point of intersection of the line connecting the center of bend and the heating means and the line crossing said line at right angles thereto during the bending of the pipe by the pivotable arm, said angle being selected to compensate for spring back of the material when the material is unclamped so that the material has the desired bending radius when the material is unclamped.

5. In a hot bending method for bending elongated material in which the material to be worked passes through a heating device such as a high frequency inductor capable of effecting high temperature heating on a limited area, with the leading end or a suitable middle part of said material being clamped to an arm pivotable about an axis within the plane of the heating device, the arm having a length that matches the bending radius of the material, and then continuously and straightforwardly advancing the material while heating the material locally by the heating device to a plastic deformation inducing temperature and thereafter immediately followed by cooling with the application of a bending moment to the material to cause continuous plastic deformation in the heated area of the material, the improvement wherein change of the bending radius of the material through spring back of the material after unclamping is reduced by maintaining the material in a position while bending, such that the longitudinal axis of the unbent portion of the material at the point of intersection of the material and a first line connecting the center of the bend with the heating means is turned a suitable angle with respect to a second line at right angles to said first line to compensate for spring back of the material when the material is unclamped, so that the material has a bending radius approximately equal to the length of the arm when the material is unclamped.

6. The method of claim 5, wherein the heating means is disposed on a straight line in the direction of advancement of the unbent material and at a position in the path of the advance of the material, a suitable distance from a line perpendicular to said straight line and passing through the center of the bend to compensate for the springback of the material when the material is unclamped.

7. The method of claim 5 wherein the heating means is moved responsive to change in the curvature of the bent portion of the material to maintain the bending radius constant.

8. The method of claim 5 wherein the unbent portion of the material is turned through a suitable angle responsive to change in the radius of curvature of the bent portion of the material to maintain the bending radius constant.

* * * * *